US006126349A

United States Patent [19]

Kelders

[11] Patent Number: 6,126,349

[45] Date of Patent: Oct. 3, 2000

[54] FLUID DISPENSING DEVICE

[75] Inventor: Johannes Hubertus Jozef Maria Kelders, RL Drumen, Netherlands

[73] Assignee: Henkel Kommanditgesellschaft auf Aktien, Dusseldorf-Holthausen, Germany

[21] Appl. No.: 09/117,195

[22] PCT Filed: Jan. 23, 1997

[86] PCT No.: PCT/NL97/00023

§ 371 Date: Jan. 11, 1999

§ 102(e) Date: Jan. 11, 1999

[87] PCT Pub. No.: WO97/27781

PCT Pub. Date: Aug. 7, 1997

[30] Foreign Application Priority Data

Jan. 26, 1996 [NL] Netherlands ..... 1002182

[51] Int. Cl.[7] ..... A46B 11/06

[52] U.S. Cl. ..... 401/36; 401/16; 401/129; 401/195

[58] Field of Search ..... 401/36, 21, 23, 401/24, 25, 52, 124, 195, 16, 18, 29, 207, 209, 17, 34, 129; 222/481, 482; D19/36, 53, 66

[56] References Cited

U.S. PATENT DOCUMENTS

| | | | |
|---|---|---|---|
| D. 396,884 | 8/1998 | Davila | D19/36 |
| 3,161,904 | 12/1964 | Goldich | 401/36 |
| 4,600,327 | 7/1986 | Guzman | 401/18 |
| 4,886,080 | 12/1989 | Cole . | |
| 4,955,745 | 9/1990 | Vauquelin . | |
| 6,004,055 | 12/1999 | Cheng | 401/129 |
| 6,010,264 | 1/2000 | Scuderi et al. | 401/21 |

FOREIGN PATENT DOCUMENTS

| | | |
|---|---|---|
| 0002301 | 6/1979 | European Pat. Off. . |
| 0627182 | 12/1994 | European Pat. Off. . |
| 2330353 | 6/1977 | France . |
| 1757096 | 1/1971 | Germany . |
| 3044223 | 12/1983 | Germany . |
| 2082553 | 3/1982 | United Kingdom . |
| 8907053 | 8/1989 | WIPO . |
| 9012521 | 11/1990 | WIPO . |
| 9520496 | 8/1995 | WIPO . |

*Primary Examiner*—Henry J. Recla
*Assistant Examiner*—Tuan Nguyen
*Attorney, Agent, or Firm*—Webb Ziesenheim Logsdon Orkin & Hanson, P.C.

[57] ABSTRACT

A device for dispensing a fluid. The device includes a container with a base, a plurality of side walls connecting thereto and an upper wall. The container has two closable outlet openings arranged on oppositely located sides. An applicator is placeable in one of the openings, while the other opening has a protruding needle-like dispensing member. The base of the container is situated between the outlets. In this dispensing device, when the needle-like dispensing member is placed on a surface, the outlet with the applicator is situated above the level of the fluid present in the container, whereby leakage out of this outlet opening is impossible.

13 Claims, 4 Drawing Sheets

FLUID DISPENSING DEVICE

BACKGROUND OF THE INVENTION

The invention relates to a device for dispensing a fluid comprising a container with a base, a plurality of side walls connecting thereto and an upper wall, which container has at least two closable outlet openings arranged substantially on oppositely located sides of the container, wherein an applicator is placeable in one of the openings and the other opening has a protruding needle-like dispensing member. Such a dispensing device is known from WO-A-89 07053 and serves for instance to hold and dispense a correction fluid.

This known dispensing device, which is shown in FIG. 3 of said document, has in its base an outlet in which a brush is placed and on its upper side an outlet with a pen-point. The outlet in the base is herein closed by a relatively large flat cap from which the brush protrudes on the inside and of which the flat outer side functions as a support surface for the dispensing device as a whole. In contrast to conventional dispensing devices for correction fluid, which are generally only provided with a single outlet in which is placed a brush fixed to a cap, this device has the advantage that it can be used in a number of ways. For correction of larger errors use can thus be made of the brush, with which a relatively large quantity of correction fluid can be applied in one operation, while for correction of smaller errors the correction fluid can be dispensed precisely by means of the pen-point. With use of this device the chance of leakage is herein relatively small, because when the pen-point is used the other outlet located opposite will be situated above the level of the fluid present in the container.

The known device does however have the drawback that there is a relatively great danger of the brush drying out. This is because the dispensing device, when not in use, is placed on the cap from which the brush protrudes upward. This has the result that, when the level of the correction fluid in the container falls, the brush will gradually protrude above the level of the fluid and will thereby dry out. With such a dried-up brush the correction fluid cannot be applied accurately.

In addition, this dispensing device has the drawback that the container cannot be put down when the brush is being used because the opening closed off by the cap with brush is situated in the base of the container. The container will therefore have to be held every time it is used, which may prove extremely awkward.

From DE-C-3044223 is likewise known a dispensing device of the above described type. In this known dispensing device the cap having the brush therein is also arranged on the underside of the container. However, in view of the proportions, the cap is herein evidently not intended to function as support surface for the device, and it would therefore seem that this device, which is substantially cylindrical, is intended to be put down in the manner of a normal pen. This entails in practice that the dispensing device will have to be put away in a pen tray. It is further also the case for this device that it must be held when the brush is being used.

SUMMARY OF THE INVENTION

The invention therefore has for its object to provide an improved fluid dispensing device of the above described type. According to the invention this is achieved in that the base is situated between the outlets. The dispensing device can thus be put down when not in use without the danger of the applicator drying up.

The outlets preferably each have a centre line and at least the centre line oft he outlet accommodating the applicator encloses an angle with the plane of the base whereby particularly the outlet in which the applicator must be placed is well accessible and normally also situated above the surface of the fluid during use of the applicator. It is hereby unnecessary to always hold the device in the hand.

The needle-like dispensing member preferably extends to a position close to the surface of the base. This ensures that the needle-like member is situated at most times beneath the level of the fluid present in the container, thus preventing drying out. The centre lines of the outlets can herein be substantially parallel.

Preferably arranged in the outlet accommodating the applicator is a resilient stretchable sleeve which fits closely round this applicator. Leakage of fluid along the applicator can hereby be prevented. In order to also ensure a good sealing by the sleeve when the applicator is not placed fully in the container, the sleeve and the applicator preferably comprise co-acting cylindrical parts extending over a determined length, wherein the diameter of the cylindrical part of the sleeve is at most equal to that of the cylindrical part of the applicator.

The sleeve further has an end edge which serves to wipe off fluid adhering to the applicator and to close off the opening when the cap with applicator is removed from the container. In order to ensure a good wiping action of this end edge of the sleeve the applicator preferably has a portion with small diameter for receiving this end edge of the sleeve when the applicator is placed fully into the container. The end edge of the sleeve is hereby not tensioned at most times, whereby no relaxation of the material of the sleeve occurs. The sleeve can otherwise be clamped releasably in the outlet.

A well-stretchable end edge of the sleeve is obtained when it is divided by incisions into a plurality of flaps tapering to a point. For an optimum wiping action the sleeve therein has a number of layers of flaps each tapering to a point, wherein the flaps of each layer are shifted relative to those of an adjacent layer. When the flaps of a first layer are pressed apart the points of the flaps of the adjacent layer therefore cover the thus formed spaces between the flaps of the first layer.

Finally, the invention further relates to a sleeve for use in a dispensing device as described above.

BRIEF DESCRIPTION OF THE DRAWINGS

The invention is now elucidated on the basis of an example, wherein reference is made to the drawings, in which.

DESCRIPTION OF THE PREFERRED EMBODIMENT

Figure 1:
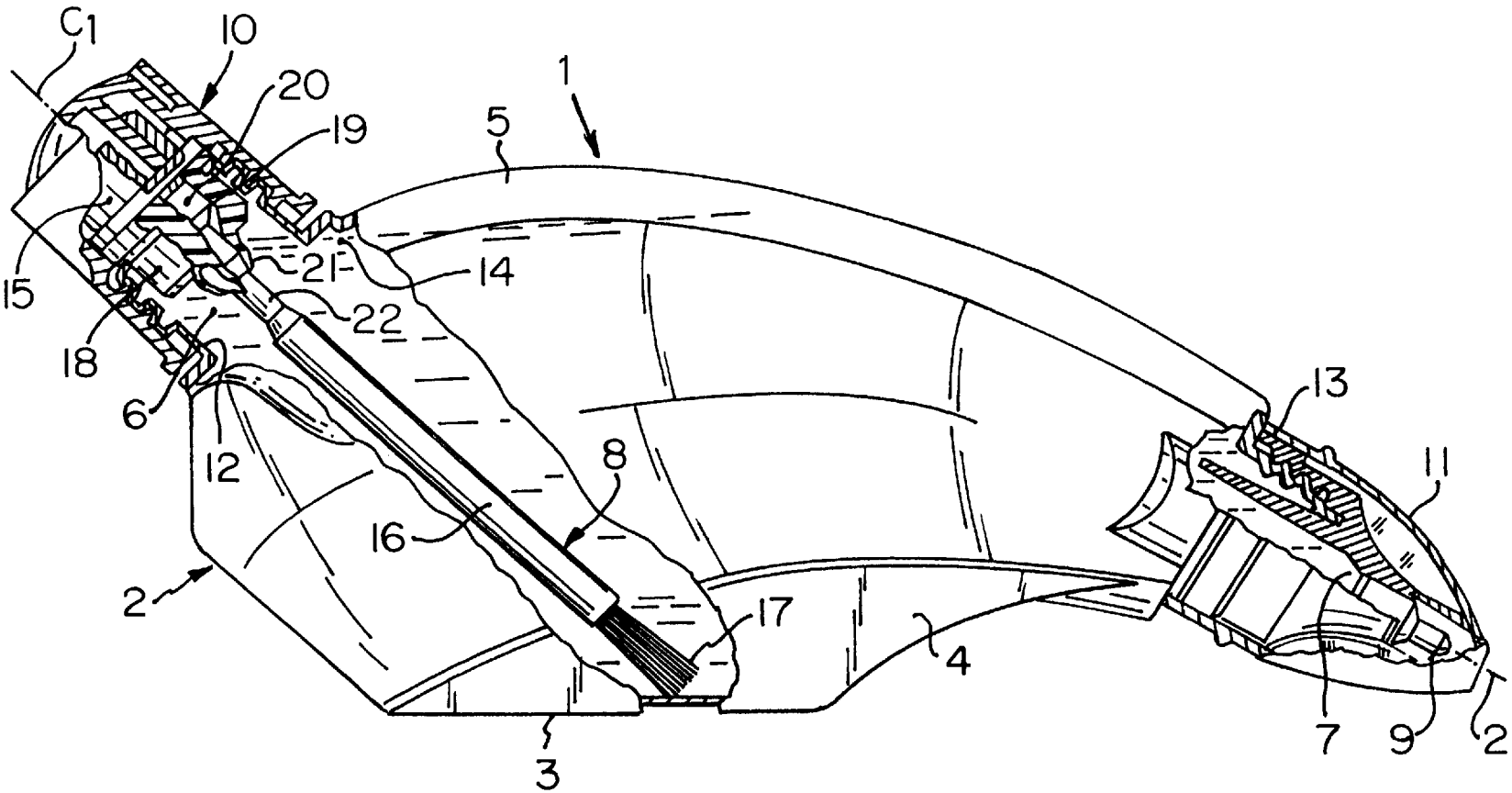
FIG. 1 shows a partly cut away side view of the dispensing device according to the invention in a rest position.

A device 1 (FIG. 1) for dispensing a fluid comprises a container 2 defining a reservoir with a base 3, a plurality of side walls 4 connecting thereto and an upper wall 5. In the shown example two outlets 6, 7 are arranged in container 2 and into the reservoir, wherein an applicator 8 can be placed in outlet 6, while outlet 7 is provided with a protruding needle-like dispensing member 9 of per se known design arranged thereon, and communicating with the reservoir.

Both openings 6, 7 can be closed by means of a cap 10, 11, wherein the cap 10 is a screw cap which can be screwed over a neck 12 bounding outlet 6, while the cap 11 can be pushed over dispensing member 9 and is connected to the container by means of a snap edge 13. As is usual, the cap 10 is formed integrally with the applicator 8.

Figure 2:
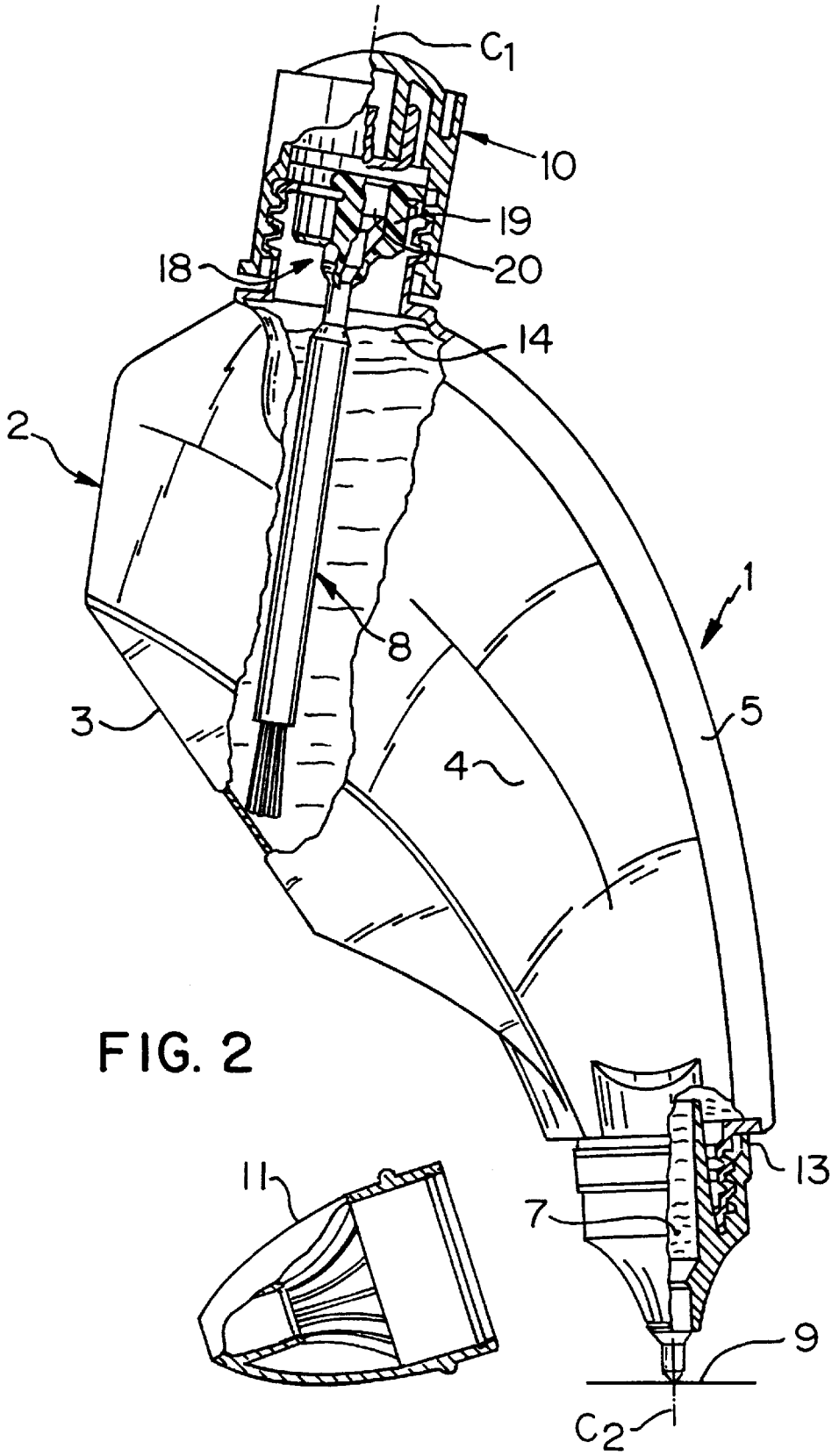
FIG. 2 shows a view corresponding with FIG. 1 of the dispensing device in a first position of use.

The outlets 6 and 7 are arranged substantially opposite each other, while the base 3 is situated between the outlets 6, 7. This arrangement of outlets 6, 7 prevents leakage through the outlet 6 when dispensing member 9 is being used. The placing of the base 3 herein makes it possible to put away the dispensing device 1 when it is not in use. In order to obtain an optimum accessibility, particularly of outlet 6, and still limit the danger of leakage as much as possible, the centre line C1 of outlet 6 is placed at an angle relative to the plane of the base 3 such that outlet 6 is situated above the fluid level 14 and the dispensing device can ordinarily be left standing when applicator 8 is being used and opening 6 is therefore not closed off. The centre line C2 of outlet 7 is also placed in the shown embodiment at an angle to the base 3 wherein the centre lines C1 and C2 are practically parallel, whereby dispensing member 9 extends to a position practically in line with the base 3. In this manner is ensured that in virtually all circumstances the dispensing member 9 is located below the level 14 of the fluid contained in container 2 (FIG. 2).

The applicator 8 comprises an end part 15 fixed into the cap 10, a rod 16 connecting thereto and an applicator head 17. In order to prevent as far as possible any possible leakage of fluid along the rod 16 to the cap 10 a resilient stretchable sleeve 18 is clamped in the neck 12 of outlet 6. This sleeve 18 has a cylindrical part 19 which co-acts with a cylindrical part 20 on the upper part of applicator 8, in order to form a seal which is also active when the cap 10 with the applicator 8 fixed thereto is not screwed fully onto the container 2. The cylindrical parts 19, 20 extend for this purpose over a length which practically corresponds with the height of the screw thread part on neck 12 and thus form a clamping seal which is effected the moment the cap 10 is placed on the neck 12 at the beginning of the screw thread.

Figure 3:
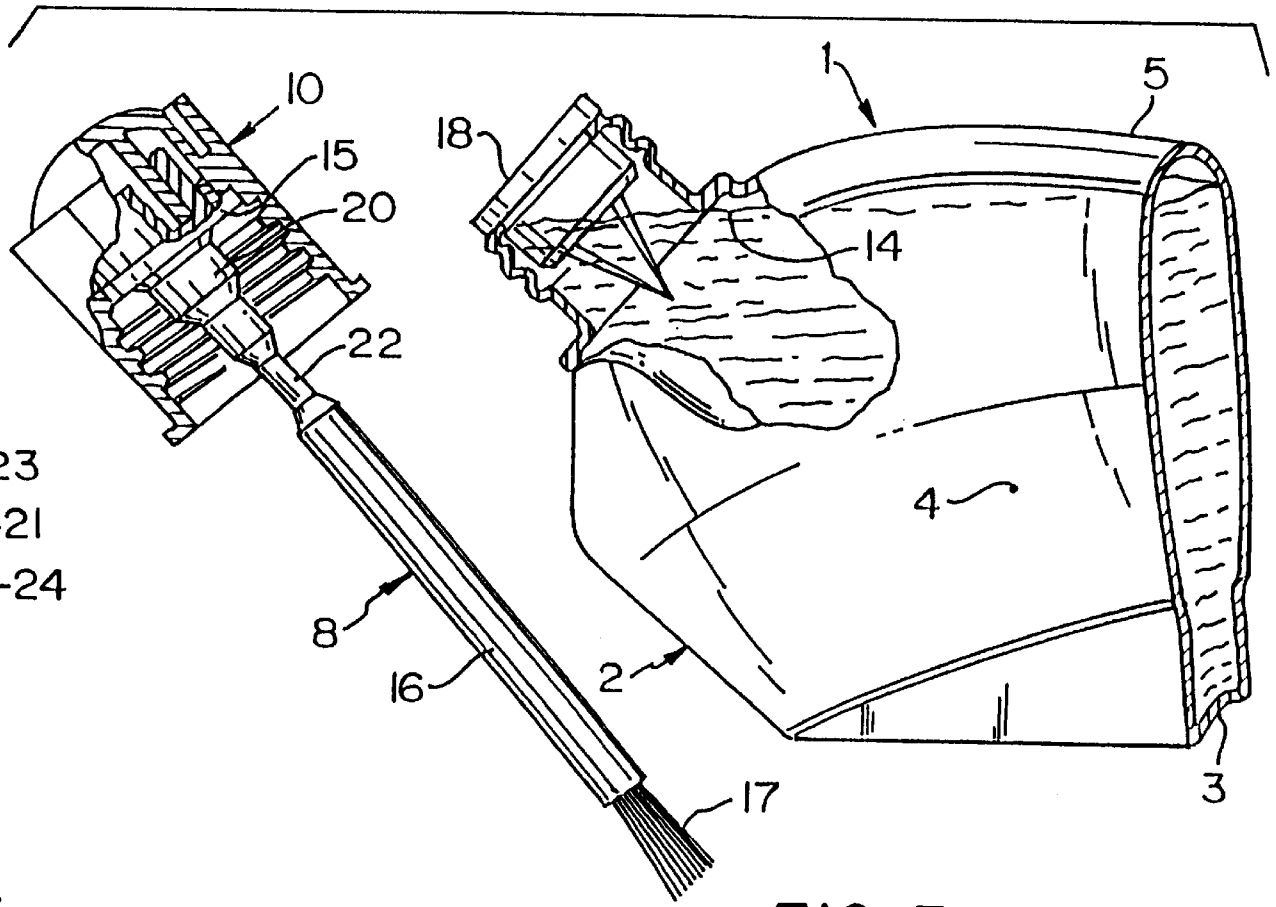
FIG. 3 shows a partial view of the dispensing device in a second position of use, with the applicator removed.
Figure 4:
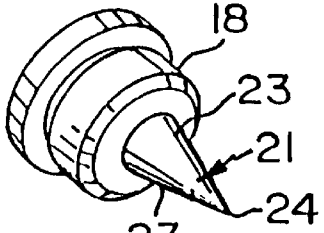
FIG. 4 is a perspective view of a sleeve for arranging in the outlet of the dispensing device.
Figure 5:
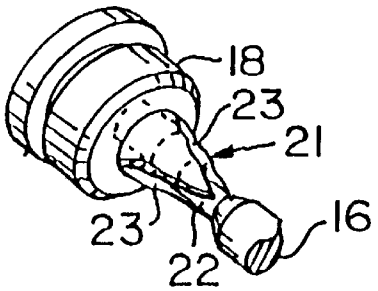
FIG. 5 is a view corresponding with FIG. 4 of the sleeve with the applicator placed therethrough.

The sleeve 18 is further provided with a knurled end edge 21, which fits very closely round the rod 16 of applicator 8 and whereby fluid possibly adhering to the rod 16 is wiped off when applicator 8 is removed from container 2 (FIG. 5). This end edge 21 is in fact formed by a plurality of separate flaps which are mutually separated by incisions 23 and which, in their non-tensioned position when not clamped round the rod 16 of applicator 8, rest against each another in a point 24 (FIG. 4) and thus function as closure for the outlet 6 (FIG. 3). In order to ensure the necessary tension in this end edge 21 the rod 16 of applicator 8 is provided with a portion 22 with reduced diameter in which the end edge 21 comes to rest when applicator 8 is screwed fully into the container. Excessive stretching of the edge as a result of relaxation of the resilient material is thus prevented.

Figure 6:
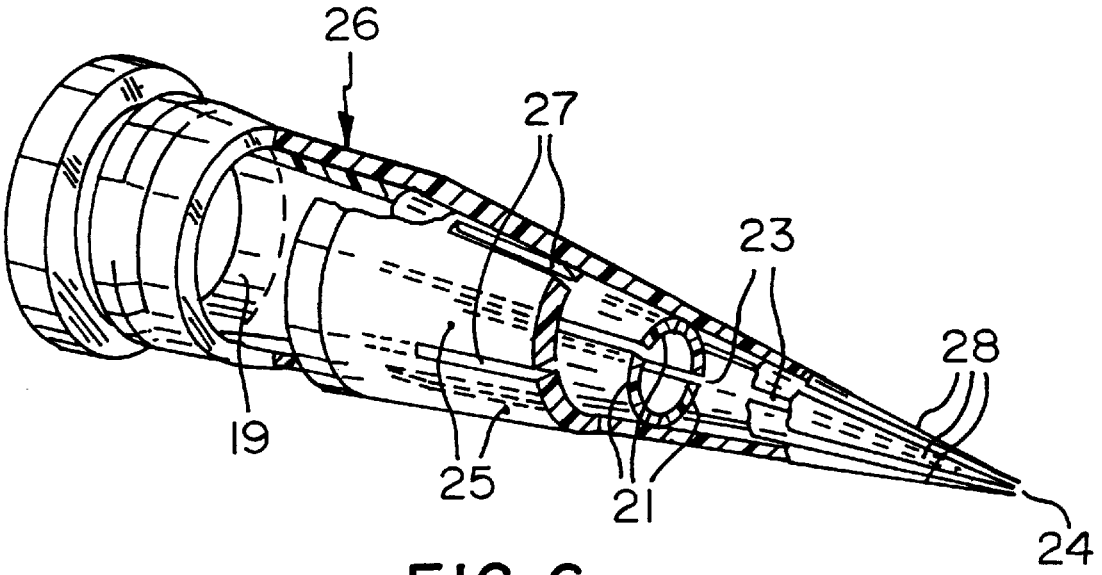
FIG. 6 shows a view corresponding with FIGS. 4 and 5 of an alternative embodiment of the sleeve.

In order to achieve a good wiping action as well as a good closure, the sleeve 26 can be provided in another embodiment with a number of layers of flaps 21, 25 (FIG. 6). Herein the flaps 25 of the outer layer, which are mutually separated by incisions 27 and which likewise come together in a point 24, are shifted as seen in peripheral direction relative to the flaps 21 of the inner layer. The tips 28 of these flaps 25 thus fall into the spaces created between flaps 21 when these latter are bent outward by the passage of the rod 16 of applicator 8. In the shown embodiment each layer otherwise comprises four flaps 21, 25, so that the layers are shifted through an angle of 45° relative to one another. It is self-evident that in the case of a different number of flaps 21, 25 per layer this angle will also be chosen differently.

The dispensing device 1 according to the invention can thus be used in two ways. By unscrewing the cap 10 and taking out the applicator 8 connected thereto comparatively large quantities of the fluid can be dispensed, wherein the dispensing device 1 can be placed securely with its base 3 on a surface such that there is a minimal risk of container 2 falling over and leakage thereby occurring (FIG. 3). Furthermore, the unclosed outlet 6 is herein situated above the fluid level 14, while on the other side the needle-like dispensing member 9 remains immersed in the fluid.

On the other hand, by picking up the container 2 and placing the needle-like dispensing member 9 into contact with the surface, a relatively small quantity of fluid can thereby be dispensed accurately. This dispensing takes place under the influence of the force of gravity such that container 2 must be placed for this purpose above dispensing member 9 (FIG. 2). Herein the other outlet 6 will in all circumstances be situated above the fluid level 14 in container 2 as a result of its position opposite outlet 7, whereby leakage is practically impossible.

What is claimed is:

1. A device for dispensing a fluid, comprising:

a container defining a reservoir having a substantially flat base, a plurality of side walls and an upper wall;

at least two closable outlet openings in the container;

an applicator removably placeable in one of the openings and into said reservoir; and a protruding needle-like dispensing member located in the other opening and communicating with said reservoir, wherein the outlet openings are arranged on substantially opposed sides of the container, wherein the base is located between the outlets, and wherein the needle-like dispensing member extends substantially to a plane containing the base.

2. The device as claimed in claim 1, wherein the outlets each have a centre line and at least the centre line of the outlet accommodating the applicator encloses an angle with the plane container the base.

3. The dispensing device as claimed in claim 2, including a resilient stretchable sleeve arranged in the outlet accommodating the applicator and fitting closely round the applicator when the applicator is in the container.

4. The dispensing device as claimed in claim 1, wherein the centre lines of the outlets are substantially parallel.

5. The dispensing device as claimed in claim 4, including a resilient stretchable sleeve arranged in the outlet accommodating the applicator and fitting closely round the applicator when the applicator is in the container.

6. The dispensing device as claimed in claim 1, including a resilient stretchable sleeve arranged in the outlet accommodating the applicator and fitting closely round the applicator when the applicator is in the container.

7. The dispensing device as claimed in claim 6, wherein the sleeve and the applicator comprise co-acting cylindrical parts extending over a finite length, and wherein the diameter of the cylindrical part of the sleeve is at most equal to that of the cylindrical part of the applicator.

8. The dispensing device as claimed in claim 7, wherein the applicator has a portion with reduced diameter for receiving an end edge of the sleeve when the applicator is place fully into the container.

9. The dispensing device as claimed in claim 7, wherein the sleeve is clamped releasably in the outlet.

10. The dispensing device as claimed in claim 6, wherein the applicator has a portion with reduced diameter for receiving an end edge of the sleeve when the applicator is placed fully into the container.

11. The dispensing device as claimed in claim 6, wherein the sleeve is clamped releasably in the outlet.

12. The dispensing device as claimed in claim 6, wherein an end edge of the sleeve is divided by incisions into a plurality of flaps tapering to a point.

13. The dispensing device as claimed in claim 12, wherein the sleeve has a plurality of layers of flaps each tapering to a point, and wherein the flaps of each layer are arranged in shift position relative to those of an adjacent layer.

* * * * *

UNITED STATES PATENT AND TRADEMARK OFFICE

CERTIFICATE OF CORRECTION

PATENT NO. : 6,126,349

DATED : October 3, 2000

INVENTOR(S) : Johannes Hubertus Jozef Maria Kelders

It is certified that error appears in the above-identified patent and that said Letters Patent is hereby corrected as shown below:

Title Page [75] Inventor: city of "Drumen" should read --Drunen --.

Column 2 Line 6 "oft he" should read --of the--.

Column 5 Line 2, Claim 2, "container" should read --containing--.

Column 6 Line 4, Claim 8, "place" should read --placed--.

Column 6 Line 21, Claim 13, "shift" should read --shifted--.

Signed and Sealed this

Eighth Day of May, 2001

*Attest:*

Nicholas P. Godici

NICHOLAS P. GODICI

*Attesting Officer*

*Acting Director of the United States Patent and Trademark Office*